US005225144A

United States Patent [19]

Nanba et al.

[11] Patent Number: 5,225,144

[45] Date of Patent: Jul. 6, 1993

[54] GAS-CARBURIZING PROCESS AND APPARATUS

[75] Inventors: Keishichi Nanba, Yokohama; Yoshihiko Kitayama, Kyoto; Fukitaka Abukawa, Yokohama; Hitoshi Goi, Yokohama; Masahiko Watanabe, Yokohama, all of Japan

[73] Assignees: Tokyo Heat Treating Company, Kanagawa; Mitsubishi Jidosha Kogyo Kabushiki Kaisha, Tokyo, Japan

[21] Appl. No.: 851,962

[22] Filed: Mar. 16, 1992

Related U.S. Application Data

[62] Division of Ser. No. 699,305, Apr. 12, 1991, Pat. No. 5,133,813.

[30] Foreign Application Priority Data

Jul. 3, 1990 [JP] Japan ..... 2-175955
Nov. 9, 1990 [JP] Japan ..... 2-118042

[51] Int. Cl.[5] ..... C21D 1/06

[52] U.S. Cl. ..... 266/251; 266/252

[58] Field of Search ..... 266/251, 252

[56] References Cited

U.S. PATENT DOCUMENTS 3,284,074 11/1966 Kotatko et al. ..... 266/252
4,279,406 7/1981 Bourhis et al. ..... 266/252

*Primary Examiner*—John P. Sheehan
*Attorney, Agent, or Firm*—Bauer & Schaffer

[57] ABSTRACT

A gas-carburizing process wherein an article is treated by feeding a hydrocarbon gas and an oxidative gas of raw material gases directly into an atmospheric heat treating furnace, characterized in that, when the pressure within the furnace is negative, $CO_2$ is fed as a negative pressure dissolving means.

A gas-carburizing apparatus wherein a gas inlet for feeding a hydrocarbon gas and an oxidative gas provided in the ceiling part of an atmospheric heat treating furnace is provided with a $CO_2$ feeding part for dissolving the negative pressure within the furnace.

2 Claims, 4 Drawing Sheets

GAS-CARBURIZING PROCESS AND APPARATUS

This is a divisional of Ser. No. 699,305 filed Apr. 12, 1991, now U.S. Pat. No. 5,133,813.

TECHNICAL FIELD

This invention relates to a gas-carburizing process and apparatus for hardening the surface of a steel part by diffusing carbon in the surface layer of the steel part.

BACKGROUND OF THE INVENTION

In the general gas carburizing process, not only an atmospheric heat treating furnace (called a heat treating furnace hereinfter) but also a transforming furnace has been conventionally required.

Such transforming furnace is to obtain a transformed gas necessary for the atmospheric heat treatment, is charged with a catalyst within it and is fed with a hydrocarbon gas and air in a retort heated from outside.

The gas obtained from the above mentioned transforming furnace is fed to the above mentioned heat treating furnace and further a carburizing gas is added to the gas to adjust the carbon potential of the atmospheric gas within the heat treating furnace in a carburizing process.

However, with the above mentioned conventional process, there have remained such problems that, as not only the heat treating furnace but also the transforming furnace is required, the heating energy and expensive catalyst are requuired and further it is expensive to maintain and control the heater and retort.

Therefore, in consideration of the uneconomy accompanying the use of the above mentioned transforming furnace, the applicant of the present case has provided a process for feeding a hydrocarbon gas and oxidative gas directly into a heat treating furnace without using a transforming furnace (Japanese Patent Publication No. 38870/1989).

In this process, a hydrocarbon gas and a small amount of pure oxygen are introduced into a heat treating furnace kept above 730° C. and a nitrogen gas is excluded to carry out a carburizing process.

That is to say, when a hydrocarbon gas and pure oxygen are introduced into a heat treating furnace kept at a predetermined temperature, an atmosphere necessary for carburization will be produced to carry out carburization.

According to this process, as only the gas contributing directly to carburization is fed into the heat treating furnace, the apparent partial pressure of CO in the atmosphere will not be reduced by the gas not contributing directly to the carburization, the carburizing efficiency is high, further no transforming furnace is required, the used amount of the hydrocarbon gas is small and the process is very economical.

However, in the above mentioned process, the amount of the gas fed into the furnace is so smaller than in the case of the process using the carburizing gas transformed in the above mentioned transforming furnace that, with the opening and closing of an inlet door, intermediate door and outlet door when an article to be treated is put in and moved, the pressure within the furnace will become negative, atmospheric air (oxygen) will be sucked in through the packing part of the door and the atmosphere within the furnace will be disturbed to cause a danger of an explosion or the like.

Therefore, the applicant of the present application has provided an atmospheric furnace pressure adjusting apparatus wherein, when the pressure within the furnace is negative, a ring burner provided in an atmospheric air introducing path will be ignited to feed the combustion gas into the furnace to dissolve the negative pressure within the furnace (Japanese Utility Model Application Publication No. 16766/1989).

If this apparatus is used, when the pressure within the furnace is negative, oxygen will not be introduced and the furnace will be safe but the $N_2$ gas not directly contribution to the above mentioned carburization will be introduced to reduce the partial pressure of CO within the furnace.

By the way, the basic gas reaction of the carburization is as follows:

$$\frac{CO}{CO_2} = K\frac{H_2}{H_2O} \quad (1)$$

$$2CO \rightarrow [C] + CO_2 \quad (2)$$

That is to say, the gas contributing directly to the carburization is CO, the larger the partial pressure of CO, the more active the carburization, a carburized layer of a required hardness and depth can be formed within a short time, further the dispersion of the carburization of a treated article of a complicated form can be reduced and a pore or the like can be effectively carburized.

DISCLOSURE OF THE INVENTION

This invention is to provide a more economic gas-carburizing process wherein, as mentioned above, when the pressure within a heat treating furnace is negative, the $N_2$ gas or the like not contributing directly to the carburization will be prevented from being introduced so that the partial pressure of CO in the atmosphere may not be reduced and the quality of the treated article may be improved.

That is to say, in the process of the invention, when the pressure within a heat treating furnace is negative, $CO_2$ will be fed so that the negative pressure within the furnace may be dissolved and the partial pressure of CO in the atmosphere may be increased.

Also, in the apparatus of the present invention, without using a transforming furnace, a hydrocarbon gas and oxidative gas are fed directly into a heat treating furnace and, when the pressure within the heat treating furnace is negative, $CO_2$ will be able to be quickly fed.

DETAILED DESCRIPTION OF THE INVENTION

An embodiment of the present invention shall be explained in the following with reference to the drawings.

Figure 1:
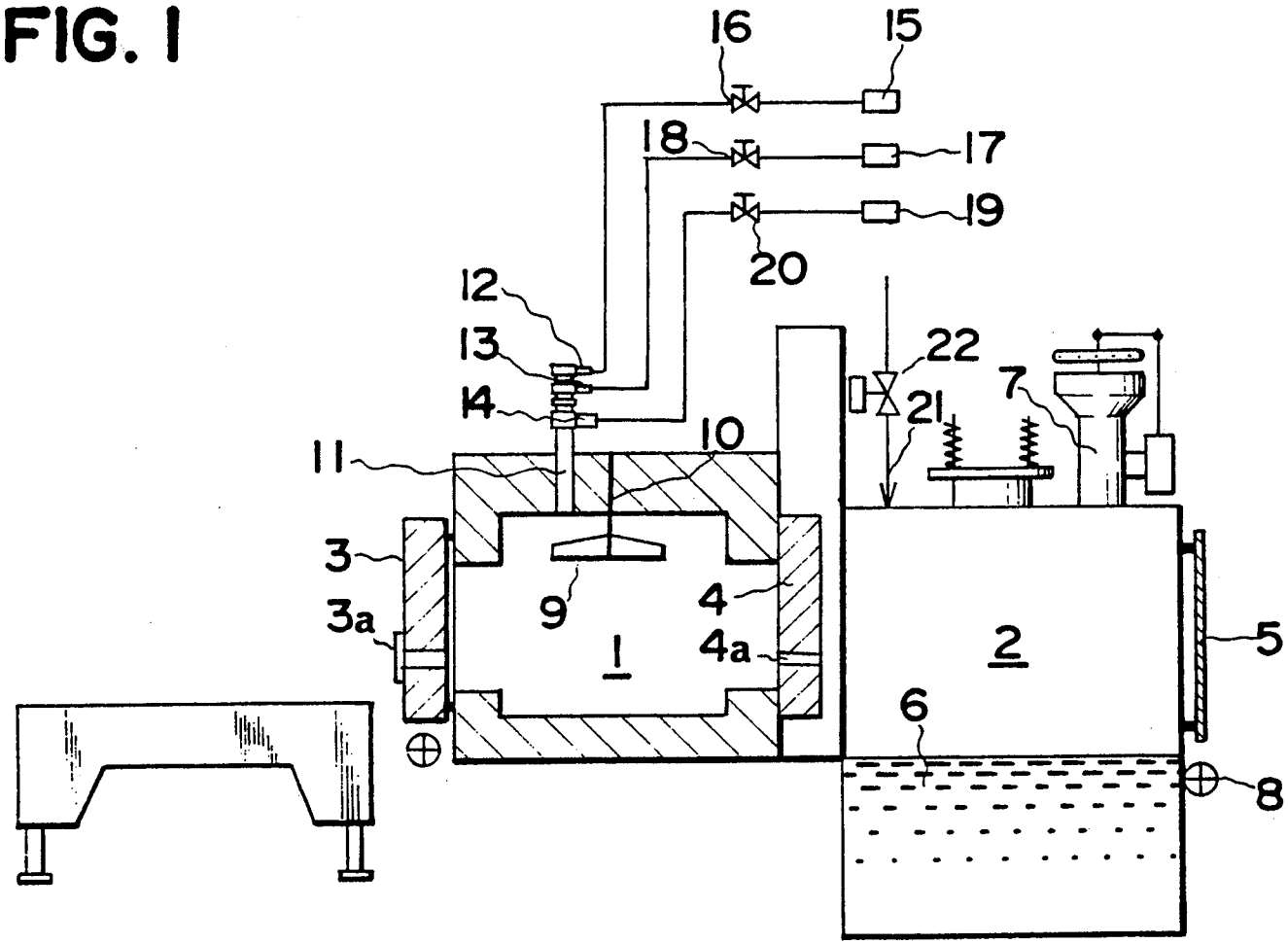
FIG. 1 is a vertically sectioned view of a batch type heat treating furnace.

A batch furnace is shown in FIG. 1 in which the reference numeral 1 represents a heating chamber, 2 represents a cooling chamber (quenching chamber), 3 represents an inlet door of the heating chamber 1, 3*a* represents an opening and closing port provided in the inlet door 3, 4 represents an intermediate door, 4*a* represents an outflow port provided in the intermediate door 4, 5 represents an outlet door of the cooling chamber 2, 6 represents a cooling oil, 7 represents a furnace pressure adjusting apparatus of the above mentioned atmospheric furnace, 8 represents a curtain frame ignited when the outlet door 5 is opened, 9 represents an agitating fan which is supported in the ceiling part by a fan shaft 10 and is rotated by a motor (not illustrated) provided outside and 11 represents a gas inlet provided in the ceiling part adjacently to the above mentioned agitating fan 10 to feed a hydrocarbon gas and oxidative gas.

In the same drawing, the reference numeral 12 represents a hydrocarbon gas feeding port, 13 represents an oxidative gas feeding port, 15 represents a hydrocarbon gas source, 16 represents an opening and closing valve controlling the fed amount of the above mentioned hydrocarbon gas, 17 represents an oxidative gas source and 18 represents an opening and closing valve controlling the fed amount of the above mentioned oxidative gas.

In the carburizing apparatus of the present invention, further a $CO_2$ feeding part is formed in the above mentioned gas inlet 11.

Concretely a $CO_2$ feeding port 14 is formed at the end outside the furnace of the above mentioned gas inlet 11 and further a $CO_2$ source 19 is connected to the above mentioned $CO_2$ feeding port through an opening and closing valve 20 controlling the fed amount of $CO_2$.

By the way, if the apparatus is formed so that the high pressure $CO_2$ may be fed as required from the feeding port 14, the soot deposited in the above mentioned gas inlet 11 as detailed later will be able to be removed without disturbing the atmosphere within the furnace. Also, the reference numeral 21 represents a $CO_2$ feeding path to the cooling chamber 2 and 22 represents an opening and closing valve controlling the fed amount of the above mentioned $CO_2$.

In the above mentioned formation, when the inlet door 3 of the heating chamber 1 is opened, an article to be treated is put into the heating chamber 1 and the inlet door 3 is closed, much air will have entered the heating chamber 1.

Needless to say, the temperature within the heating chamber 1 is so high that $O_2$ in the air will have been perfectly consumed by the combustion with the atmospheric air and the $N_2$ gas will remain.

Therefore, in the present invention, the opening and closing valve 20 is opened, $CO_2$ is fed into the heating chamber 1 and, at the same time, the opening and closing port 3*a* provided in the inlet door 3 is opened to discharge the $N_2$ gas within the heating chamber out of the furnace.

The opening and closing port 3*a* is provided in the above mentioned inlet door 3 in order to elevate the efficiency of discharging the $N_2$ gas within the heating chamber 1, because, in case the above mentioned opening and closing port 3*a* is not provided, the $N_2$ gas within the heating chamber 1 will come to the cooling chamber 2 through the outflow port 4*a* or the like of the intermediate door 4, will push up the opening and closing valve (not illustrated) of the furnace pressure adjusting apparatus 7 of the above mentioned atmosphere and will be discharged out of the furnace.

However, in fact, a large amount of the $N_2$ gas will remain within the cooling chamber 2, will further leak through the packing part of the intermediate door 4 and will be circulated within the heating chamber 1 in some case.

Therefore, the opening and closing port 3*a* lower in the resistance than the outflow port 4*a* of the intermediate door 4 and larger than the outflow port 4*a* is provided so that the $N_2$ gas may be preferrably discharged through the above mentioned opening and closing port 3*a*.

Also, the feed of the above mentioned $CO_2$ is to prevent a negative pressure phenomemon from being temporarily produced in case an article to be treated is put at the normal temperature into the heating chamber 1 and the inlet door 3 is closed. Then, in quenching the article being treated, in case the intermediate door 4 is opened and the article is transferred to the cooling chamber, the air within the cooling chamber 2 will be expanded by the radiation heat of the heating chamber 1 and the heated article but, when the intermediate door 4 is closed, the radiation heat from the heating chamber 1 will be interrupted and, when the article is then dipped into the cooling oil, the pressure in the cooling chamber 2 will become negative.

In order to dissolve this negative pressure, the opening and closing valve 22 is opened and $CO_2$ is fed to the cooling chamber 2 to prevent the negative pressure phenomenon.

Then, the outlet door 5 is opened, the curtain frame 8 is ignited and the treated article is carried out of the furnace. When the outlet door 5 is closed and the curtain frame 8 is extinguished, the pressure within the coolinng chamber 2 will become negative again and atmospheric air will be sucked in through the above mentioned furnace pressure adjusting apparatus 7 of the atmosphere, the outlet door 5 part and the like to be likely to cause an explosion.

Therefore, the opening and closing valve 22 is opened again and $CO_2$ is fed to the cooling chamber 2 to dissolve the negative pressure.

It has been confirmed that the CO within the furnace can be maintained substantially at about 40% in the above mentioned operation.

That is to say, CO in % the atmosphere in the present invention is as follows in the calculation:

$$C_4H_{10} + 4CO_2 \longrightarrow \underset{(61.5\%)}{8CO} + \underset{(38.5\%)}{5H_2} \quad (3)$$

$$C_3H_8 + 3CO_2 \longrightarrow \underset{(60\%)}{6CO} + \underset{(40\%)}{4H_2} \quad (4)$$

$$CH_4 + CO_2 \longrightarrow \underset{(50\%)}{2CO} + \underset{(50\%)}{2H_2} \quad (5)$$

Needless to say, in the actual operation, the above mentioned calculated values will be reduced by the entry of air through the door packing part, the entry of air at the time of the negative pressure caused by the furnace operation and the like.

For example, in the case of the above mentioned formula (3), CO in % in the actual operation was about 40%.

Also, CO in % in the calculation of the invention mentioned in the above mentioned Japanese Patent Application Publication No. 38870/1989 was as follows:

$$C_4H_{10} + 2O_2 \longrightarrow \underset{(44\%)}{4CO} + \underset{(56\%)}{5H_2} \quad (6)$$

Needless to say, CO in % in the actual operation was about 30%. Further, in case air is added instead of pure oxygen, CO in % in the calculation is as follows:

$$C_4H_{10} + 10(1/5\ O_2 + 4/5\ N_2) \longrightarrow \underset{(23.5\%)}{4CO} + \underset{(29.4\%)}{5H_2} + \underset{(47.1\%)}{8N_2} \quad (7)$$

As mentioned above, according to the present invention, as different from the respective conventional processes, CO in the atmosphere is prevented as much as possible from being thinned, the carburizing capacity is not reduced, yet a carburized layer of a required hardness and depth can be formed within a short time and the process is economical.

Figure 2:
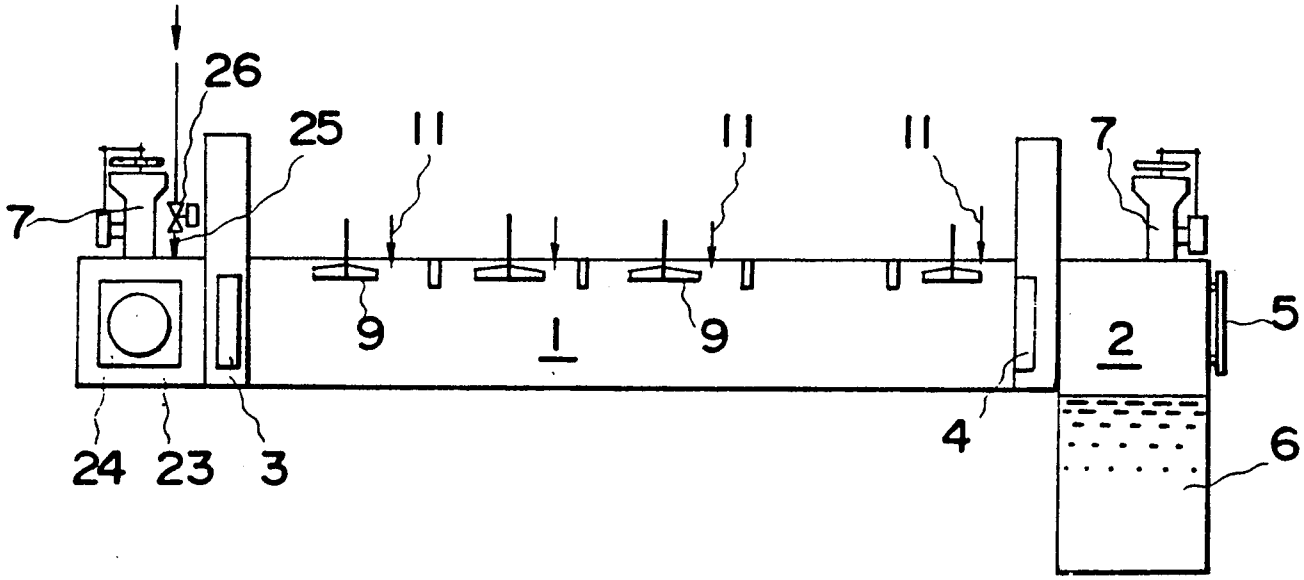
FIG. 2 is a vertically sectioned view of a continuous type heat treating furnace.

A continuous furnace is shown in FIG. 2 in which the same parts as in FIG. 1 shall bear the same reference numerals.

In FIG. 2, the reference numeral 23 represents a carry-in chamber and 24 represents a carry-in door.

In this embodiment, after the completion of the seasoning, a continuous operation will set in and then, when the carry-in door 24, inlet door 3, intermediate door 4 and outlet door 5 are closed, respective negative pressure phenomena will be produced.

Needless to say, if the inlet door 3 and intermediate door 4 are opened simultaneously with closing the carry-in door 24, one of the above mentioned negative pressure phenomena will be able to be reduced.

Also, as the furnace is continuous, even if $CO_2$ is fed to any of the carry-in chamber 23, heating chamber 1 and cooling chamber 5, the nengative pressure will be able to be dissolved.

Therefore, in the embodiment shown in the drawing, the carry-in chamber 23 is provided with a $CO_2$ feeding path 25 and an opening and closing valve 26 controlling the fed amount of $CO_2$.

By the way, also in the embodiment of this continuous furnace, the same as in the embodiment of the above mentioned batch furnace, $CO_2$ was fed to the cooling chamber 2 and the process was observed. However, it has been confirmed that, if $CO_2$ is fed to the cooling chamber 2, a grain field oxidation will increase and it is not proper.

In this embodiment, the case of opening the opening and closing valve 26 and feeding $CO_2$ is when the inlet door 3 and intermediate door 4 are closed and when the outlet door 5 is closed except the above mentioned case.

Also, in this embodiment, only the hydrocarbon gas is made to flow in the heating chamber 1 and the oxidative gas has been confirmed to be sufficient with only the $CO_2$ purging gas of the carry-in chamber.

Figure 4:
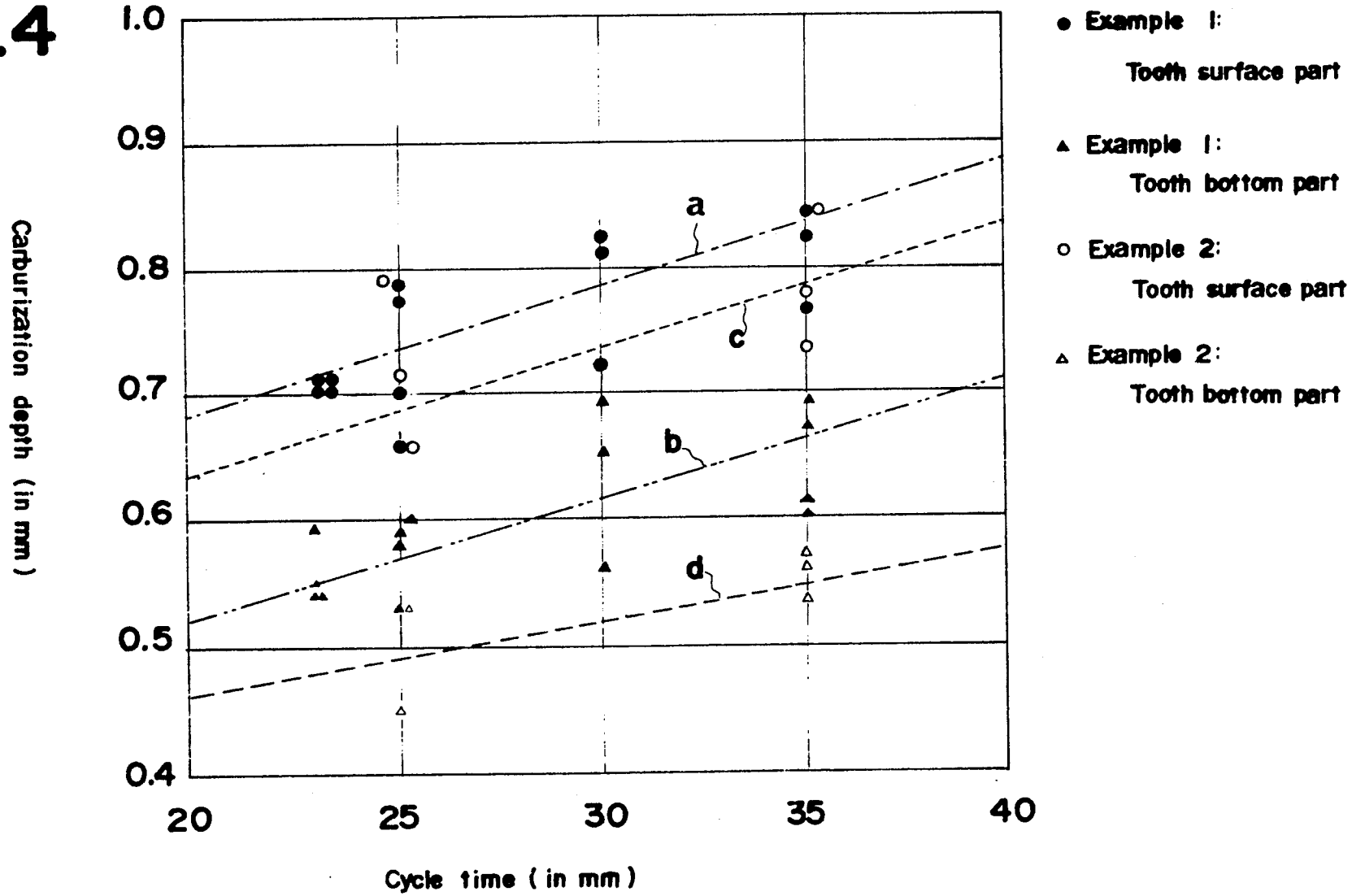
FIG. 4 is a graph showing the relation between the cycle time and carburization depth.

In FIG. 4 is shown a relation between the cycle time and carburized depth in the case that, without using a transforming furnace (gas), a hydrocarbon gas and an oxidative gas were fed directly into a furnace to carburize a gear and in the case that the same gear was treated by a conventional process.

In the graph in FIG. 4, the lines (a) and (b) are of the case by the process of the present invention, that is, the case of treating with:

EXAMPLE 1

| | |
|---|---|
| Enriched gas ($CH_4$) | 30 l/min. |
| $CO_2$ | 3 l/min. |
| $CO_2$ purging gas | 300 l/min. |

The line (a) shows the state of the tooth surface part and the line (b) shows the state of the tooth bottom part.

The lines (c) and (d) are of the case of treating for the same time as in the above mentioned present invention with a conventional process, that is,

EXAMPLE 2

| | |
|---|---|
| Enriched gas ($CH_4$) | 30 l/min. |
| Air | 3 l/min. |

The line (c) shows the state the tooth surface part and the line (d) shows the state of the tooth bottom part. As mentioned above, according to the process and apparatus of the present invention, if the time is the same, a deeper carburized depth will be able to be obtained and, in the case of obtaining the same carburized depth, the time will be able to be shortened.

It shall be described in the following to remove soot deposited within the above mentioned gas inlet 11.

Figure 3:
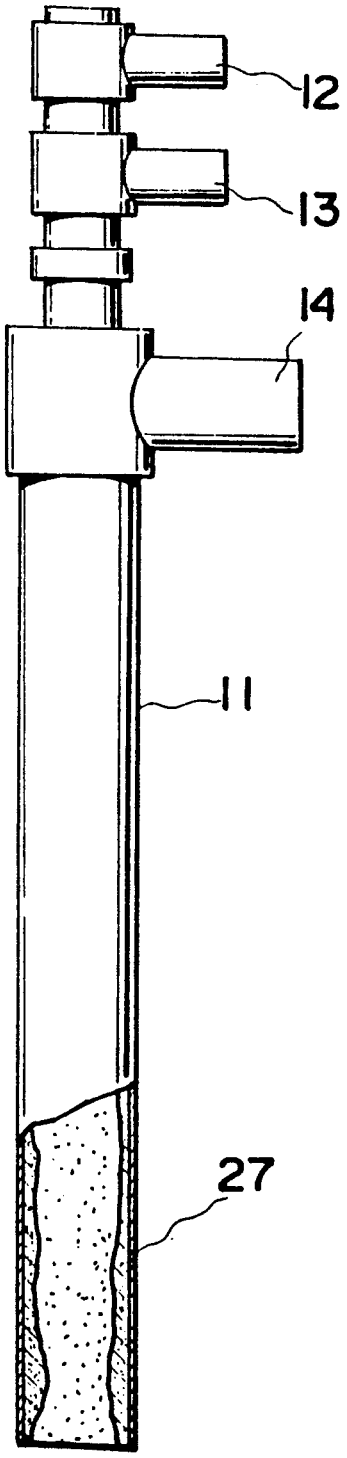
FIG. 3 is a partly sectiioned magnified elevation of a gas inlet.

In the gas-carburizing process of the above mentioned present invention, that is, if a hydrocarbon gas and an oxidative gas are mixed within the gas inlet 11 and are fed into the furnace, they will incompletely pyrolize in a sooting temperature region before they reach the furnace at a high temperature, will be deposited as soot 27 within the gas inlet 11 as shown in FIG. 3 to narrow the gas feeding path within the gas inlet 11 and will become powder particles which will drop on the upper surface of the article to be treated to generate a foul product in some case.

As a method of removing the above mentioned soot 27, an oxidative gas is fed into the gas inlet 11 to burn out the soot 27 or high pressure air is fed to forcibly remove the soot 27.

However, in either method, the partial pressure of CO within the furnace will be reduced and the quality of the treated article will be reduced.

However, in the apparatus of the present invention, if high pressure $CO_2$ is fed from the $CO_2$ feeding port 14 as synchronized with opening the inlet door 3 or carry-in door 24 in putting in the article to be treated, the above mentioned soot 27 deposited within the gas inlet 11 will be able to be removed and the partial pressure of CO will not be reduced.

By the way, the above mentioned high pressure $CO_2$ may be fed when the deposition of the soot 27 within the gas inlet 11 is confirmed or periodically.

That is to say, concretely, in the case of the batch furnace shown in FIG. 1, the high pressure $CO_2$ may be fed by opening the opening and closing valve 20 in conformity with opening the inlet door 3.

In the case of the continuous furnace in FIG. 2, as the gas inlets 11 are provided at proper intervals in the heating chamber 1, the above mentionend soot 27 will be removed sequentially.

That is to say, first of all, in the first cycle, high pressure $CO_2$ is fed to the gas inlet 11 nearest to the carry-in chamber 23 to remove the soot 27, then, in the next cycle, high pressure $CO_2$ is fed to the second gas inlet 11 to remove the soot 27 and sequentially the soot 27 of the gas inlet 11 is removed so that the deposition of the soot 27 within the gas inlet 11 may be prevented and the generation of a foul product of the treated article may be prevented.

What is claimed is:

1. Apparatus for the batch hardening of the surface of steel workpieces, comprising a heating chamber and a quenching chamber, said chambers being atmospherically connected and through which said workpieces are sequentially passed, means for feeding a hydrocarbon gas, and an oxidative gas to said heating chamber and means for feeding carbon dioxide gas to both said heating chamber and said quenching chamber, means for sensing the pressure in said quenching chamber and means for controlling the feeding of said carbon dioxide selectively to said heating and quenching chambers in response to the pressure in said chambers to thereby maintain the pressure in said chambers.

2. The apparatus according to claim 1, wherein said heating chamber has an inlet door for said workpiece be treated and an outlet door therefrom leading into said quenching chamber, each of said door having a port for the discharge of gas from the respective chambers, the port within said inlet door to said heating chamber being larger than the port in the outlet door.

* * * * *